US007874382B2

(12) United States Patent
Püttmann et al.

(10) Patent No.: US 7,874,382 B2
(45) Date of Patent: Jan. 25, 2011

(54) PNEUMATICALLY REVERSIBLE RAM BORING DEVICE

(75) Inventors: Franz-Josef Püttmann, Lennestadt (DE); Gerhard Balve, Lennestadt (DE)

(73) Assignee: Tracto-Technik GmbH, Lennestadt (DE)

( * ) Notice: Subject to any disclaimer, the term of this patent is extended or adjusted under 35 U.S.C. 154(b) by 232 days.

(21) Appl. No.: 12/094,013

(22) PCT Filed: Apr. 10, 2006

(86) PCT No.: PCT/EP2006/003274

§ 371 (c)(1),
(2), (4) Date: May 16, 2008

(87) PCT Pub. No.: WO2007/057055

PCT Pub. Date: May 24, 2007

(65) Prior Publication Data

US 2008/0257609 A1 Oct. 23, 2008

(30) Foreign Application Priority Data

Nov. 16, 2005 (DE) ..... 10 2005 055 032
Mar. 2, 2006 (DE) ..... 10 2006 010 227

(51) Int. Cl.
*E21B 4/14* (2006.01)

(52) U.S. Cl. ..... 175/296; 175/19; 173/91

(58) Field of Classification Search ..... 175/296, 175/19; 173/1, 91
See application file for complete search history.

(56) References Cited

U.S. PATENT DOCUMENTS

| | | | |
|---|---|---|---|
| 4,114,700 | A | 9/1978 | Tkach et al. |
| 4,221,157 | A | 9/1980 | Schimdt |
| 4,295,533 | A | 10/1981 | Schimdt |
| 5,086,848 | A | 2/1992 | Hudak |
| 5,307,883 | A | 5/1994 | Jenne |

FOREIGN PATENT DOCUMENTS

| | | |
|---|---|---|
| DE | 3909567 | 8/1993 |
| DE | 19858519 | 8/2002 |
| GB | 1540344 | 5/1977 |

*Primary Examiner*—Giovanna C Wright
(74) *Attorney, Agent, or Firm*—Henry M. Feiereisen; Ursula B. Day

(57) ABSTRACT

A pneumatically reversible ram boring device includes a percussion piston (8) that is situated in a casing (1) and is movable back and forth by operation air supplied via an operational-air supply via an operational-air line (5), a control pipe (4, 36, 54) having at least one control opening (13), an outer pipe (15, 65), and a control sleeve (10, 60) that can be displaced by compressed air from a control chamber (16, 66). An essentially torsion-resistant operational-air line (5) can be rotatably connected to a rotary valve (4, 40, 70) that supplies the control chamber with operational air or vents air from the chamber.

14 Claims, 20 Drawing Sheets

PNEUMATICALLY REVERSIBLE RAM BORING DEVICE

BACKGROUND OF THE INVENTION

The invention relates to a pneumatically reversible ram boring device, in particular for trenchless preparation of ground bores and for trenchless installation of lines into the earth.

Ram boring devices of this type are also used for upsizing ground bores and for destructive replacement of underground pipes; they include a self-controlling percussion piston which automatically moves back and forth in a casing by means of compressed air and which transfers its kinetic energy to the casing in forward travel at a front dead center and in backward travel at a rear dead center.

Switchover from forward travel to backward travel is accomplished with the assistance of a reversing system which with the aid of operational air decelerates the percussion piston at its forward dead center essentially without transferring kinetic energy to the casing, and also moves the rear dead center backwards, thereby ensuring that the percussion piston transfers its kinetic energy at that point to the casing.

Several versions of such reversing systems are known. They employ for adjusting the two dead center positions a control sleeve which is disposed on a control pipe for axial movement by means of compressed air, on one hand, and oftentimes by means of a pre-tensioned compression spring, on the other hand, whereby the control pipe is arranged immobile in the device casing. The reversal is implemented essentially by way of two lines of development which differ in principle from one another by using different sources for the compressed air applied to the control sleeve during switchover.

For example, British Patent 1 540 344, which corresponds to U.S. Pat. No. 4,708,211, discloses a reversal in which the operational air (compressed air) is supplied via a compressed-air hose and a non-rotatable and immovable control pipe to the percussion piston for longitudinal movement of a control sleeve, when switching from forward travel to backward travel. Switchover from backward travel to forward travel is accomplished by interrupting the supply of operational air to the device, allowing the spring-biased control sleeve to move from its rear position to the forward position.

German Patent DE 39 09 567 C2, and the corresponding U.S. Pat. No. 5,148,878 discloses a spring-pneumatic reversal for reversing from forward travel to backward travel, using a spring-biased control sleeve, which is arranged in a guide sleeve for limited rotation by means of the compressed-air hose, for releasing a control sleeve under spring tension. This spring tension is dimensioned such that the control sleeve overcomes the spring bias when the operational air is fully applied, thereby moving the control sleeve from its forward position for the forward travel to its reverse position for the backward travel. To switch from backward travel to forward travel, the pressure of the operational air opposing the compression spring needs to be reduced to allow the compression spring to move the control sleeve to its forward position. In both positions, the control sleeve is rotated about its longitudinal axis by elastic means and thereby locked in place in the axial direction.

A drawback of these spring-pneumatic reversing systems is the particularly complex and expensive construction and the use of operational air from a single source for both the operation of the percussion piston and also for reversing the direction so that the operational air has to be switched off, causing an interruption of the operation of the device; or only a reduced device power is available in the event the pressure is reduced during reversing operation.

To enable reversal of the control sleeve independent of the operational air, ram boring devices are also known which use air from a separate compressed-air source to control the axial movement of a spring-biased control sleeve. Such a device is described in the German Patent DE 198 58 519 C2, which corresponds to U.S. Pat. No. 6,371,220.

SUMMARY OF THE INVENTION

The invention is therefore directed to a ram boring device with a reversing system which is relatively simple in structure and in particular eliminates the need for an additional control-air source.

The invention is based on the concept to reverse direction with the operational air itself instead of with an additional air source, regardless as to how the actual technical implementation is realized. To this end, a pneumatic reversing system is proposed by which the control sleeve is moved by the operational air with the assistance of a valve.

The invention is based on the concept to reverse direction with the operational air itself instead of with an additional air source, regardless as to how the actual technical implementation is realized. To this end, the invention proposes in claim 1 a pneumatic reversing system by which the control sleeve is moved by the operational air with the assistance of a valve.

The valve can be constructed in many ways and is in its simplest form implemented as a closable opening in the control pipe. The valve (hereinafter also referred to as rotary valve) is connected according to the invention with a torsion-resistant hose for operational air; preferably, the valve can in its end position for the backward travel supply the control chamber of the control sleeve with operational air, and can vent the control chamber after a rotation of for example 90° into the end position for the forward travel. The rotary valve thereby enables axial displacement of the control sleeve through application of operational air. A pre-tensioned spring can also be used for returning the control sleeve.

The rotary valve can be constructed of a rotatably supported control pipe or portion of the control pipe with a radial branch bore and a longitudinal channel. The radial branch bore can be operatively connected with a operational-air opening of the control chamber in one end position of the control pipe or control pipe section, when the longitudinal channel is closed, whereas after the control pipe has been turned back into the other end position the radial bore is closed and the control chamber can be connected with the longitudinal channel for venting. As an alternative, venting may also occur, for example, via the pressure-relieve space of the percussion piston.

The control pipe can be locked in either of the two end positions by providing between the rear end of the control pipe and a connection sleeve for the operational-air hose a pressure chamber which is made, for example, of several portions and subjected to the pressure of the operational air and in which a compression spring is preferably arranged to replace the operational air in the event of a breakdown in operation or a loss of pressure so as to maintain the locked position. To provide a permanent rotational connection between the control pipe and the connection sleeve, the connection sleeve of the pressure chamber can engage an end face of the control pipe in a claw-like fashion.

For locking the control pipe in either of the two end positions, a counter sleeve which is fixed to the casing and has saddle-shaped depressions and elevations in its end face, can cooperate with a pin which is connected to the control pipe when subjected to pressure from the operational air in the compression chamber and/or from the compression spring arranged therein. The pin may, however, be arranged on the casing side and the depressions on the control pipe side.

In the rotary valve control according to the invention, the control pipe can also be arranged non-rotatably and immovably in the device casing. In one case, operational air is supplied to the control chamber of the spring-biased control sleeve via a radial branch bore for operational air and a radial channel in a control disk by way of a tubular rotary valve arranged on the control pipe in the rear section of the casing, whereas the control chamber is vented in its other end position through an axis-parallel bore, when the radial channel is closed.

The rotary valve can be constructed of a metallic disk and a coating of a permanently elastic material which includes the two aforementioned channels.

With this control technique, the spring-biased control sleeve is advantageously moved from its position for forward travel to its position for backward travel merely by a rotation—in the simplest embodiment of the control pipe—with a partial flow of the operational air branched off inside the device.

According to another preferred embodiment, the control sleeve can be displaced axially by operational air without using a spring, i.e. in both directions. The control sleeve can be constructed such that the control sleeve is moved into a functional position by pressure from the operational air (for example, into position for return travel by the driving air operating on the end face of the control sleeve), while the control sleeve returns again to the other functional position when operational air is admitted through an additional channel. This can be attained in that the operational air being admitted acts upon a comparatively larger effective area of the control sleeve. As a consequence of the supplied operational air, the control sleeve overcomes the smaller force operating in the opposite direction and resulting from the operational-air pressure supplied on the other side. In this embodiment, the rotary valve can be implemented as an independent unit or as a component of the control pipe for allowing operational air to be admitted via a randomly configured closable opening, so that this operational-air supply opposes the action of the air supply on the side of the percussion piston. As a result, operational air acting upon the end face of the control sleeve can cause a backward movement of the control sleeve, whereas the control sleeve returns again to the forward position as operational air is admitted via the closable opening.

According to the invention, axial displacement of the hose during reversal can be essentially prevented. The reversing system according to the invention is thus applicable also for great hose diameters or long hoses, i.e., for heavy hoses, without interfering in the reversing operation.

BRIEF DESCRIPTION OF THE DRAWING

Exemplary embodiments of the invention will now be described in greater detail with reference to the drawings. The drawings show in.

DETAILED DESCRIPTION OF PREFERRED EMBODIMENTS

Figure 1:
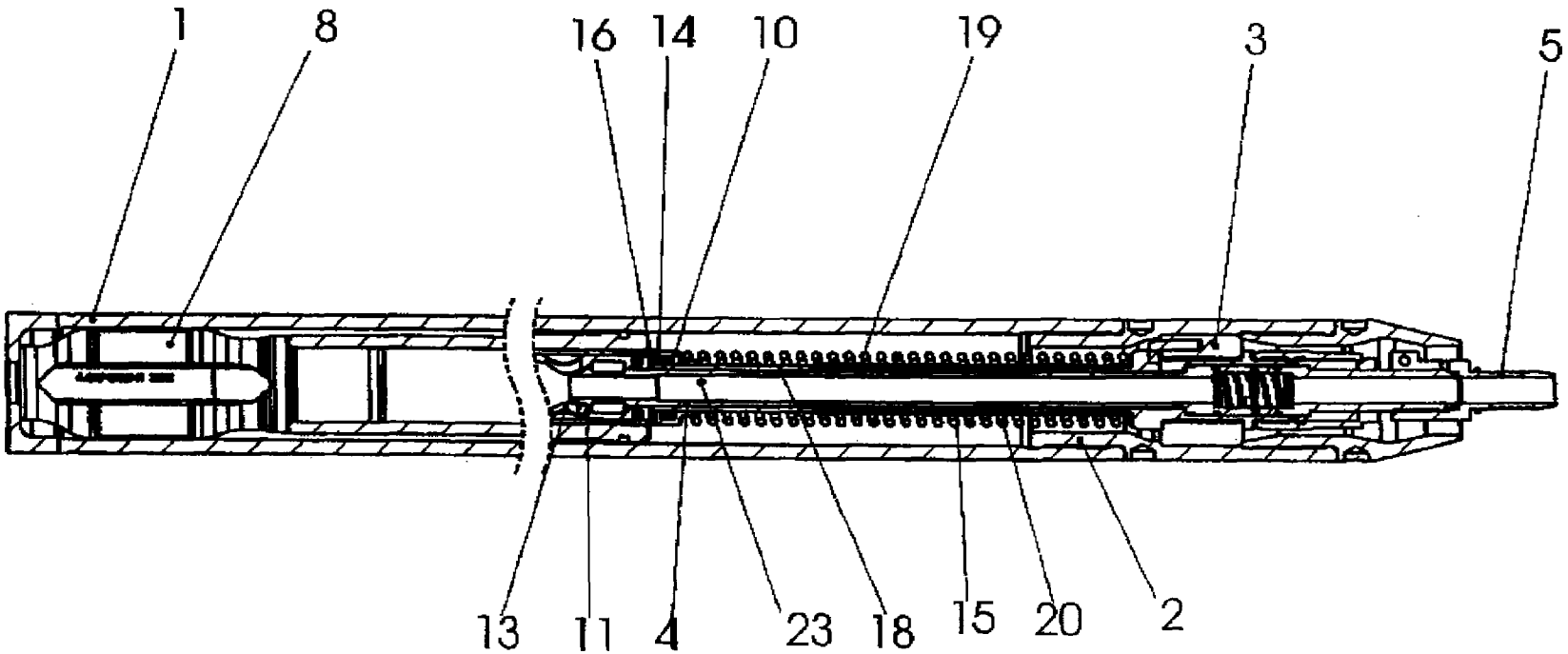
FIG. 1*a* complete illustration of a ram boring device by way of an axial longitudinal section, wherein the control pipe operates as rotary valve, FIGS. 2*a*/2*b* a view, on an enlarged scale, of the device (2*a* control sleeve side; rear end 2*b*) with the spring-biased control sleeve and a rear lock in forward-travel position, FIG. 3 a vertical section, taken along the line III-III in FIG. 2, FIGS. 4*a*/4*b* an illustration corresponding to FIG. 2, however with the control pipe and control sleeve in backward-travel position, FIG. 5 an illustration corresponding to FIG. 3, however taken along the line V-V in FIG. 4 with the control pipe and control sleeve in backward-travel position, FIG. 6 a view, on an enlarged scale, of the rear end of the ram boring device according to the FIGS. 2 to 5, FIG. 7 a longitudinal section, taken along the line VII-VII in FIG. 6, FIG. 8 a cross section, taken along the line VIII-VIII in FIG. 6, FIGS. 9*a*/9*b* a different rotary valve control (9*a* control sleeve side; rear end 9*b*) with a rotary valve arranged in the rear section of the device casing in forward-travel position, FIG. 10 a top view on a control disk of the rotary control of FIG. 12, FIG. 11 the rotary valve control of FIG. 9 in backward-travel position, FIG. 12 another rotary valve control with a rotary valve arranged in the rear section of the device casing in backward-travel position, FIG. 13 a further rotary valve control with a rotary valve arranged in the rear section of the device casing in backward-travel position, and with the control sleeve without being acted upon by a spring, FIG. 14 the rotary valve control of FIG. 13 in forward-travel position, FIG. 15 a view, on an enlarged scale, of the front end of the rotary valve control of FIG. 13, FIG. 16 a view, on an enlarged scale, of the rear end of the rotary valve control of FIG. 13, FIG. 16*a* a section of the rear end of the rotary valve control, taken along the line N-N in FIG. 16, and FIG. 17 the rotary valve control of FIG. 13 in forward-travel position and illustration of the vent passageways.

The ram boring device shown in to FIG. 1 includes a casing 1 having an interior for accommodation of a stop ring 2 with axis-parallel vent channels 3. A control pipe 4 immovably supported in the casing 1 and supplied with operational air via a torsion-resistant hose. The front end of the control pipe 4 projects into a chamber 7 which is part of a percussion piston 8 and provided with control openings 6.

Figure 2A:
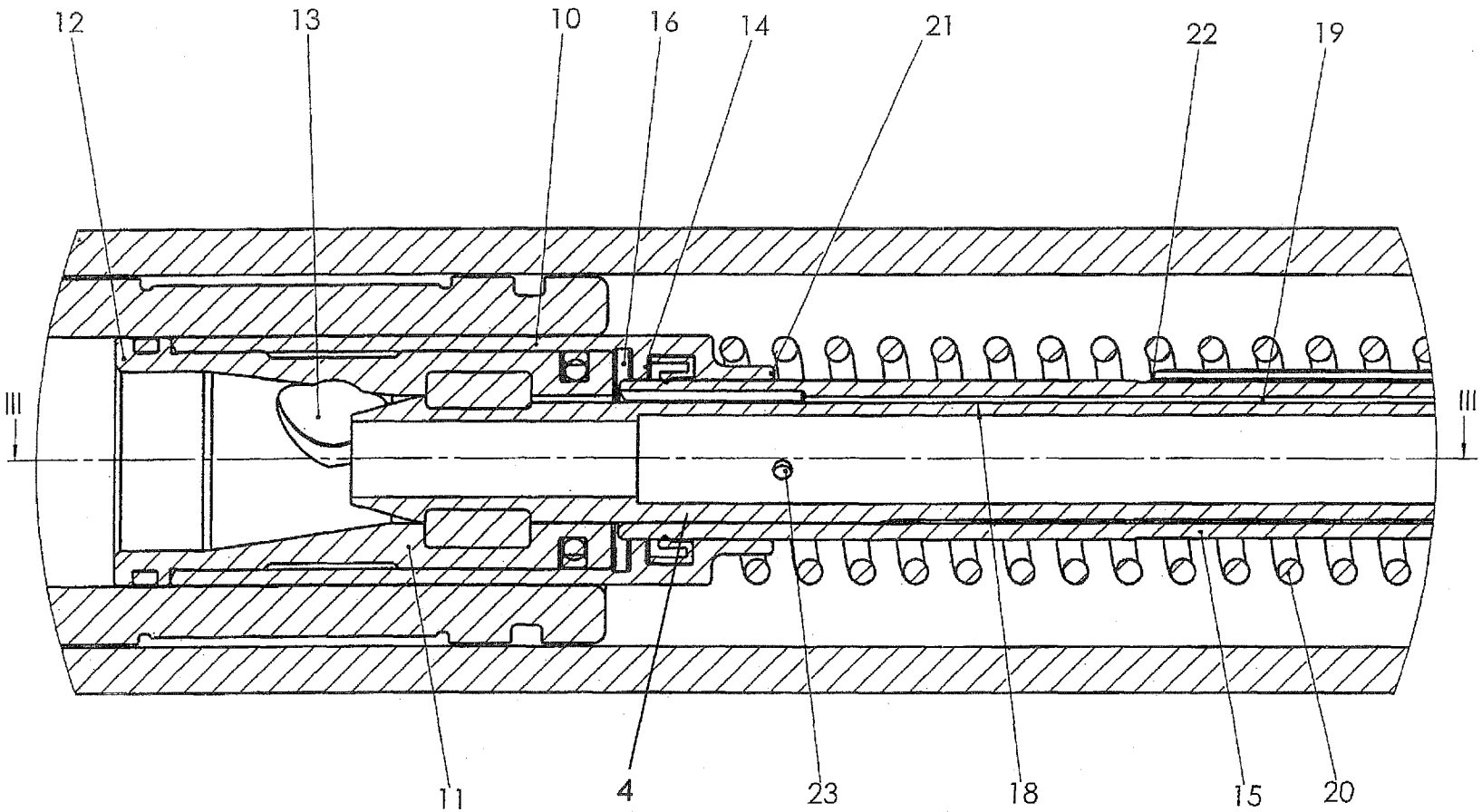
Figure 2B:
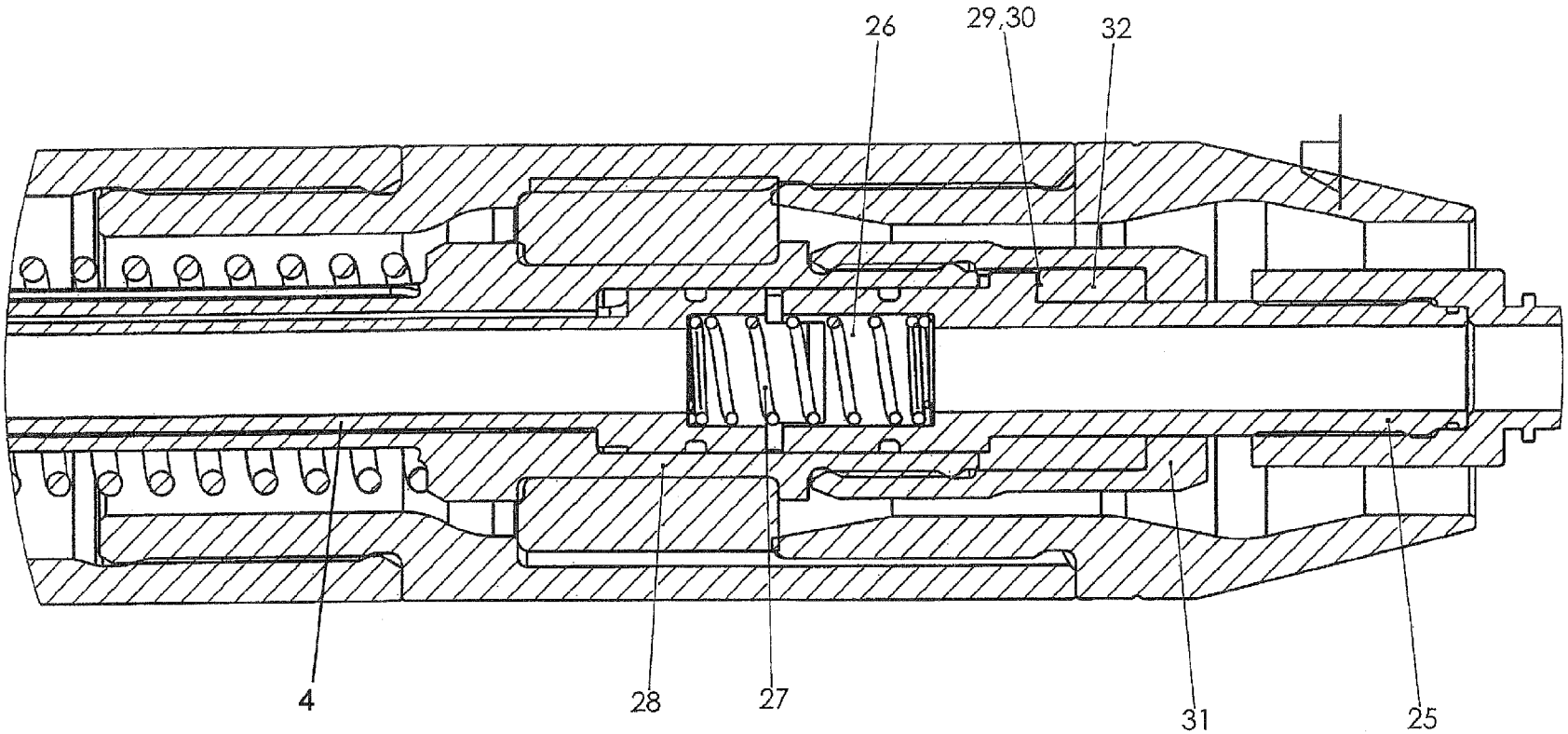
Figure 3:
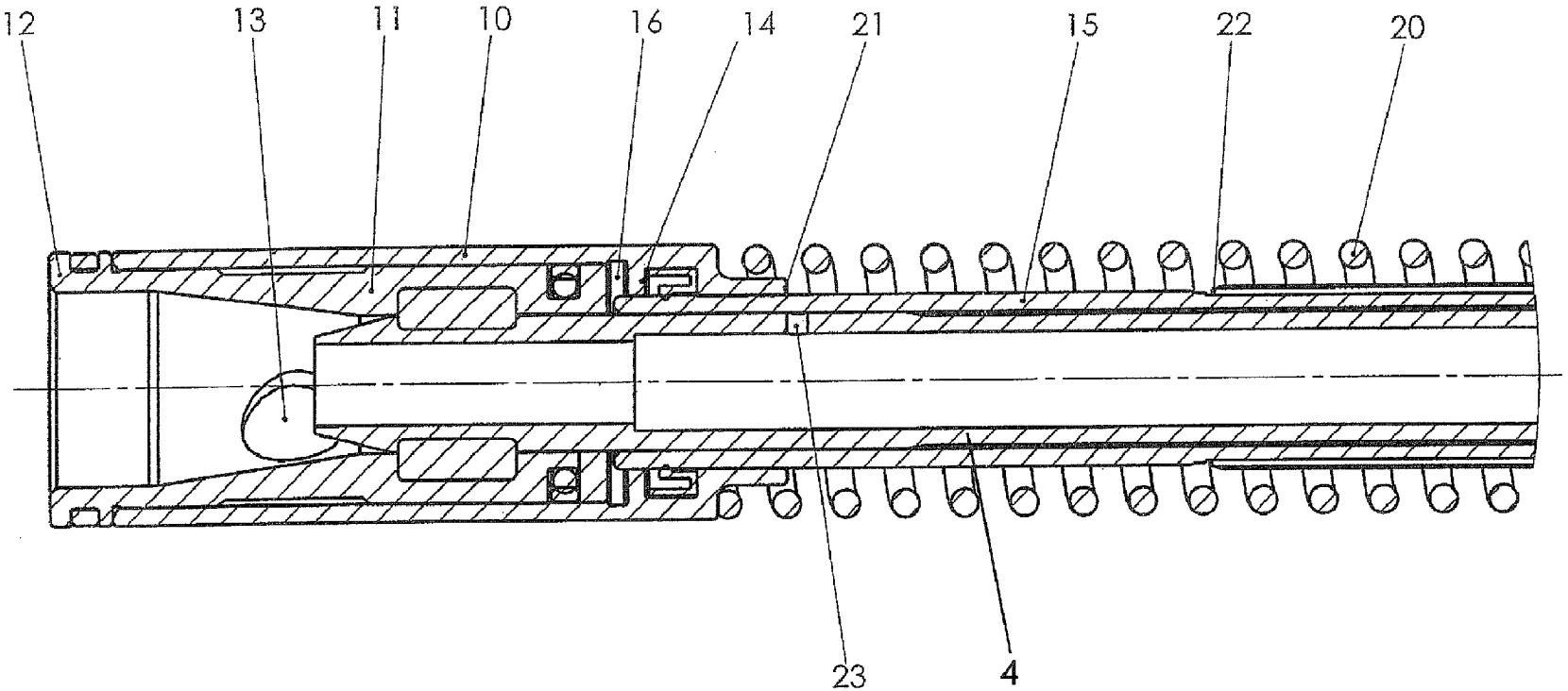

An axially movable control sleeve 10, which is movably supported on the control pipe portion 11 of greater diameter, is disposed between the control pipe 4 and the outer jacket 9 of the percussion piston chamber 7. An outer collar 12 is located at the front end surface of the control pipe 4 or control pipe portion 11 of greater diameter and covers the front face of the control sleeve 10 and is flush with the control sleeve 10 (FIG. 2*a*). Furthermore, control openings 13 are arranged in the front section 11 of the control pipe 4 of greater diameter and are covered by the control sleeve 10 during forward operation of the ram boring device, as illustrated in FIGS. 2, 3. An inner collar 14 used to guide the control sleeve 10 on the outer pipe 15 surrounding the control pipe 4 is disposed in the rear section of the control sleeve 10. A control chamber 16 in which a connecting channel 17 feeds into is located between the inner collar 14 and the rear side of the control pipe portion 11 of greater diameter. Following the connecting channel 17 is a longitudinal channel 18 which is offset radially inwards.

The channel 18 includes a longitudinal groove 19 disposed in the wall of the control pipe 4 and covered to the outside by the outer pipe 15.

The control sleeve 10 is supported in the area of the rear end of the outer pipe by a return spring 20 under tension and bears in its forward position (FIGS. 2, 3) with its inner collar 14 upon the rear side 16 of the control pipe section 11 of greater diameter and is positioned in its backward position (FIGS. 4, 5) with its rear end 21 anteriorly of a stop shoulder 22 of the outer pipe 15.

The control pipe 4 has a branch opening 23 which is closed during forward travel (FIGS. 2, 3) by the wall of the outer pipe 15 (FIG. 3), while the control chamber 16 is connected to atmosphere, i.e., vented, through the longitudinal channel 18 (FIG. 2).

Figure 4A:
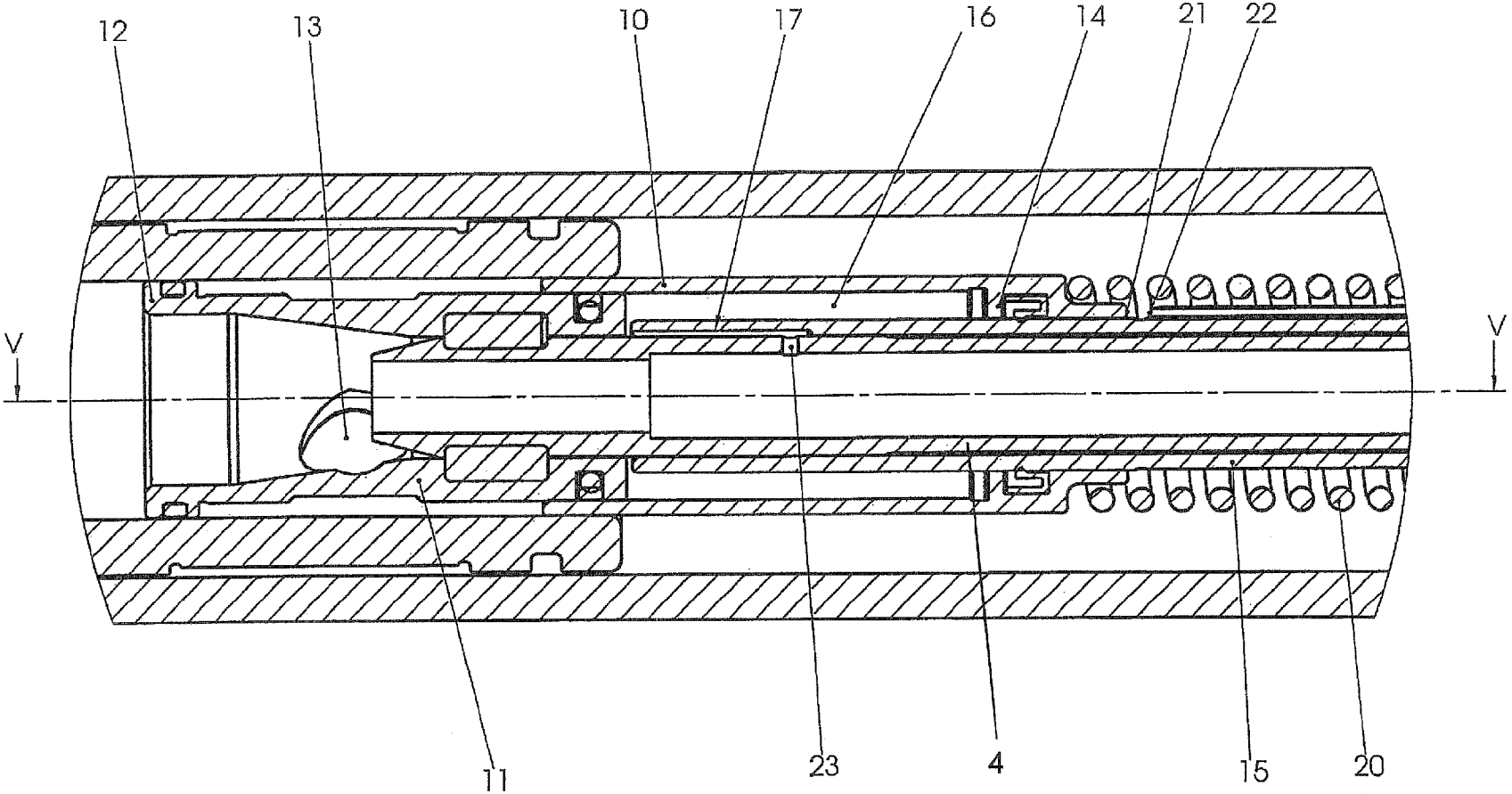
Figure 4B:
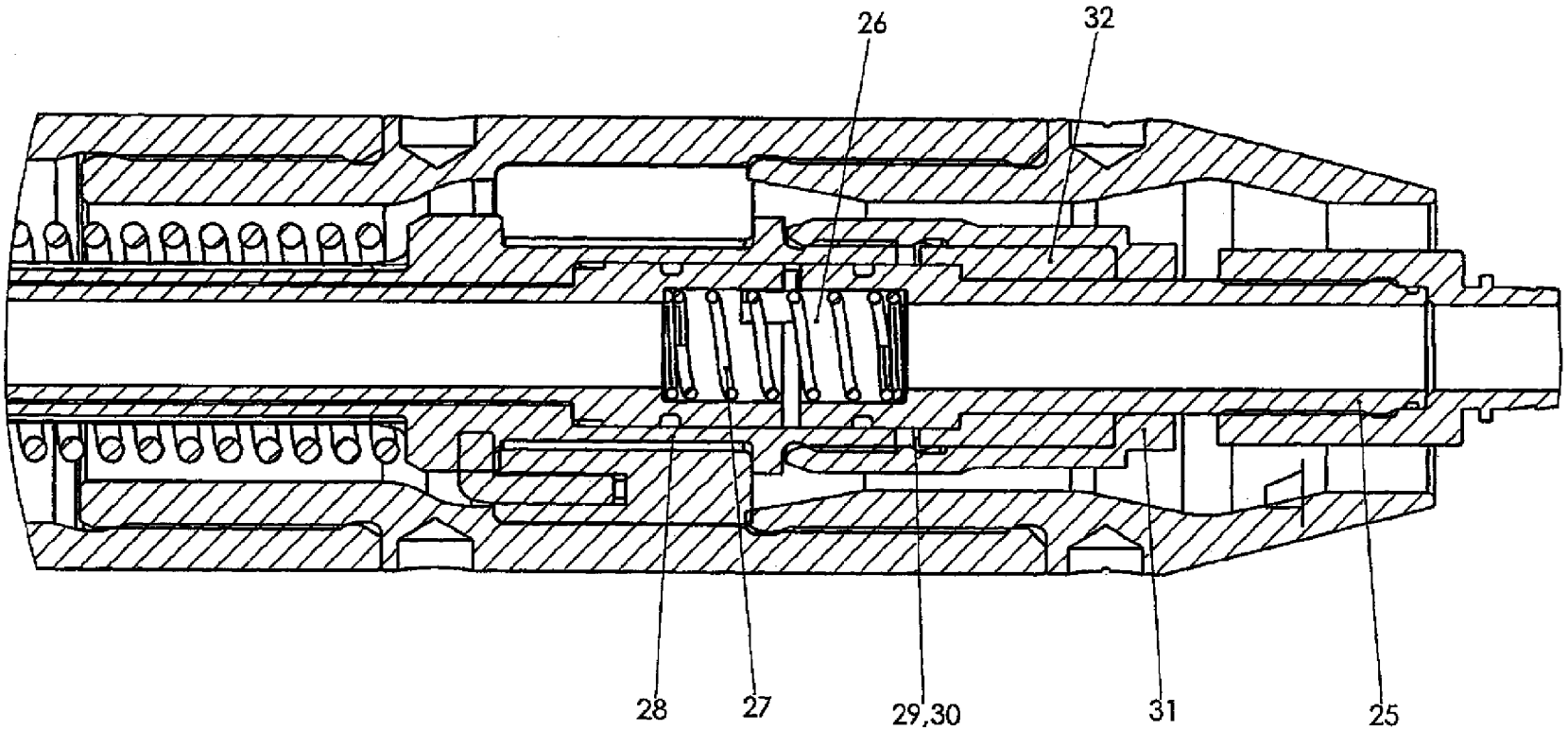
Figure 5:
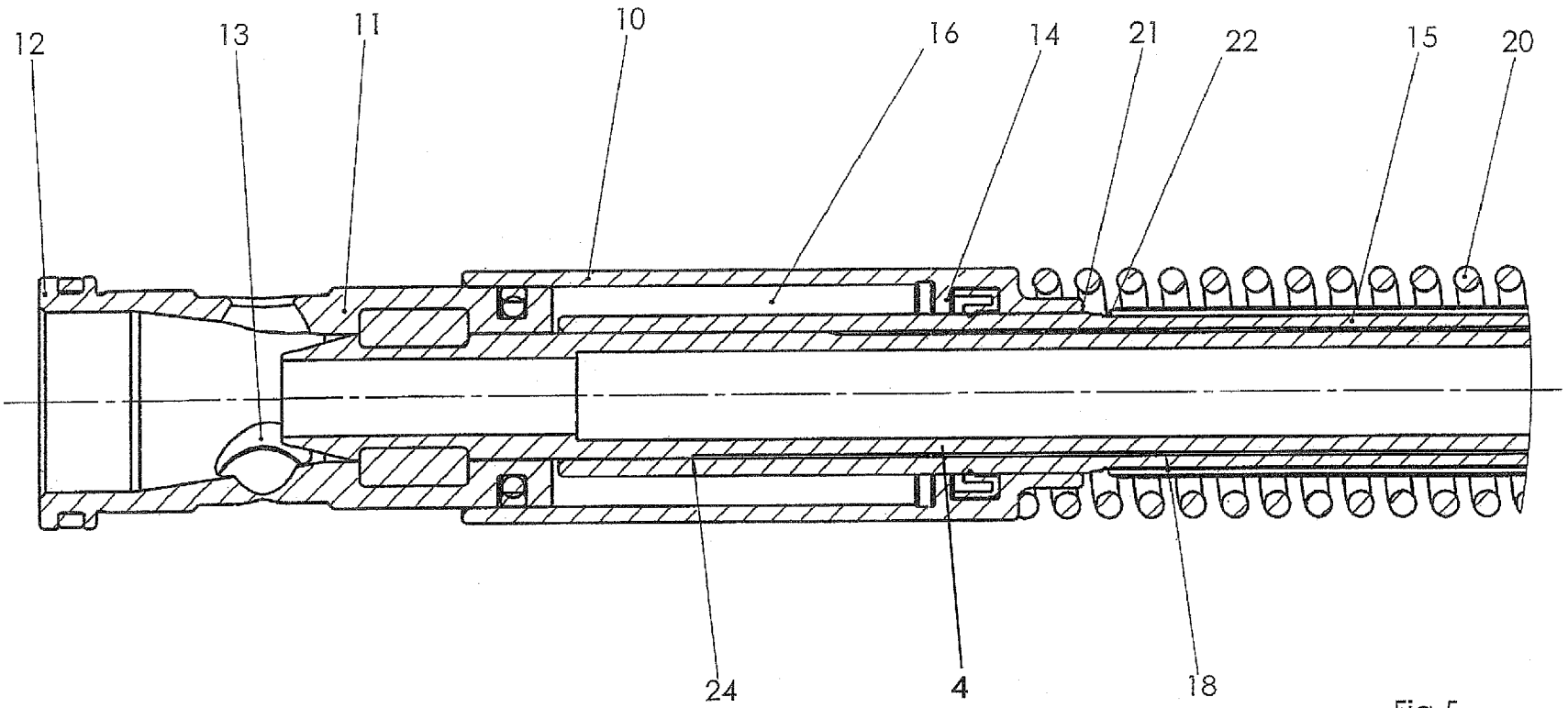
Figure 6:
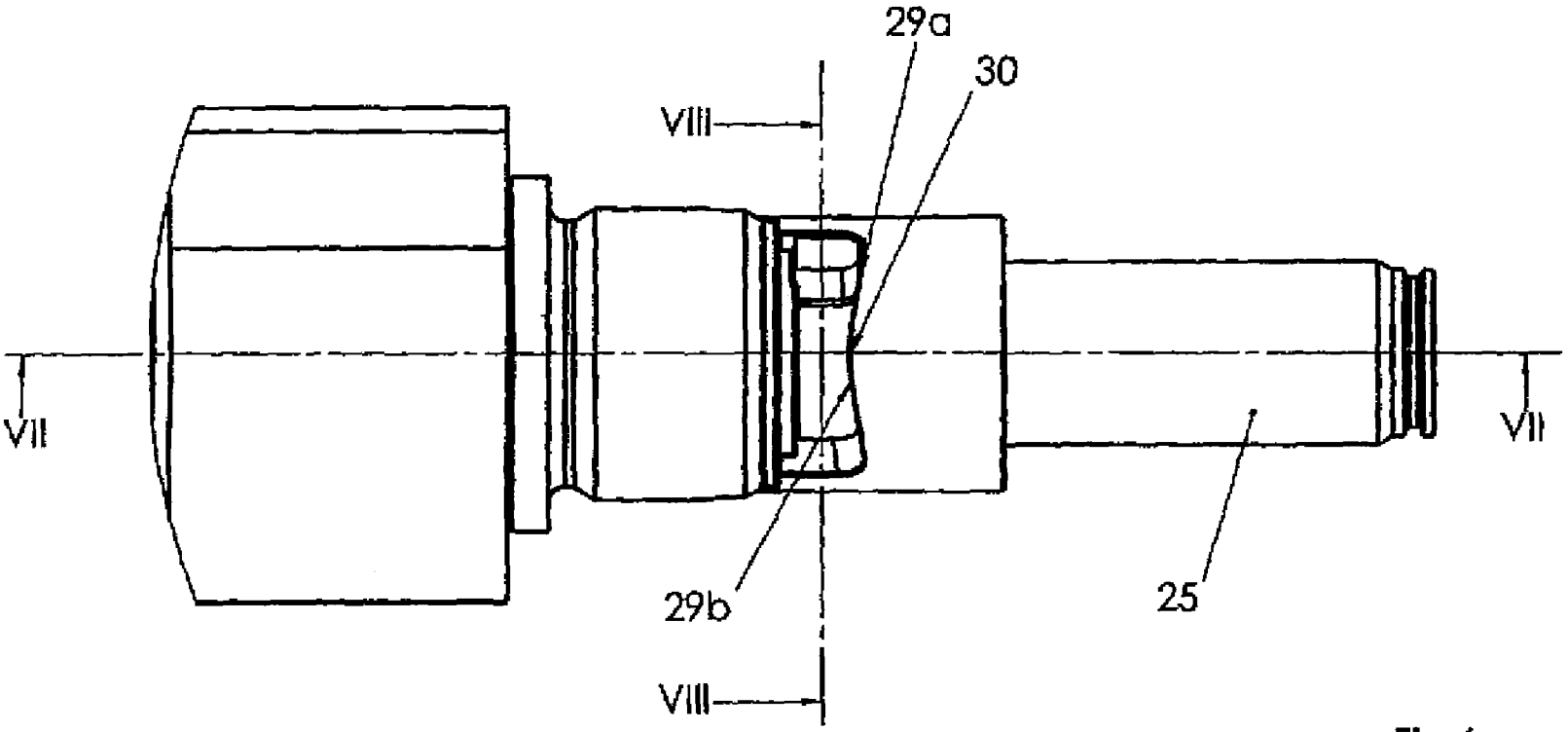

In the operating position for backward travel (FIGS. 4, 5), the branch opening 23 of the control pipe 4 is connected, after a 90° rotation, with the control chamber 16 via the radially outwardly offset front section of the connecting channel 17 (FIGS. 4*a* 4*b*), whereas the longitudinal channel 18 is closed by a shoulder 24 of the control pipe in conjunction with the outer pipe 15 (FIG. 5). As a result, the control sleeve 10 moves from its forward position (FIGS. 2, 3) against the force of the pre-tensioned spring 20 backwards into its position for the backward travel (FIGS. 4, 5).

The operating direction of the ram boring device can hence be changed in one or the other direction by a simple quarter turn of the control pipe which assumes the function of a rotary valve.

For locking the control pipe 4 in either of the two operating positions, a pressure chamber 26 made of two parts and accommodating a compression spring 27 is located between the rear end of the control pipe 4 and a connection sleeve 25 for the operational-air hose 5. Both the rear end of the control pipe 4 and the front end of the connection sleeve 25 are arranged in a tubular extension 28 of the outer pipe 15. The end surface of this extension is provided with saddle-shaped indentations 29*a*, 29*b* which cooperate with complementary elevations 30 of a counter sleeve 32 secured with a union nut 31. The union nut is screwed together with the free end of the casing extension such that it can move the connection sleeve 25 slightly out of the device casing in the axial direction either with the help of the operational air in the pressure chamber 26 and the compression spring 27 or, if no pressure is applied to the device, with the compression spring 27 alone.

Figure 7:
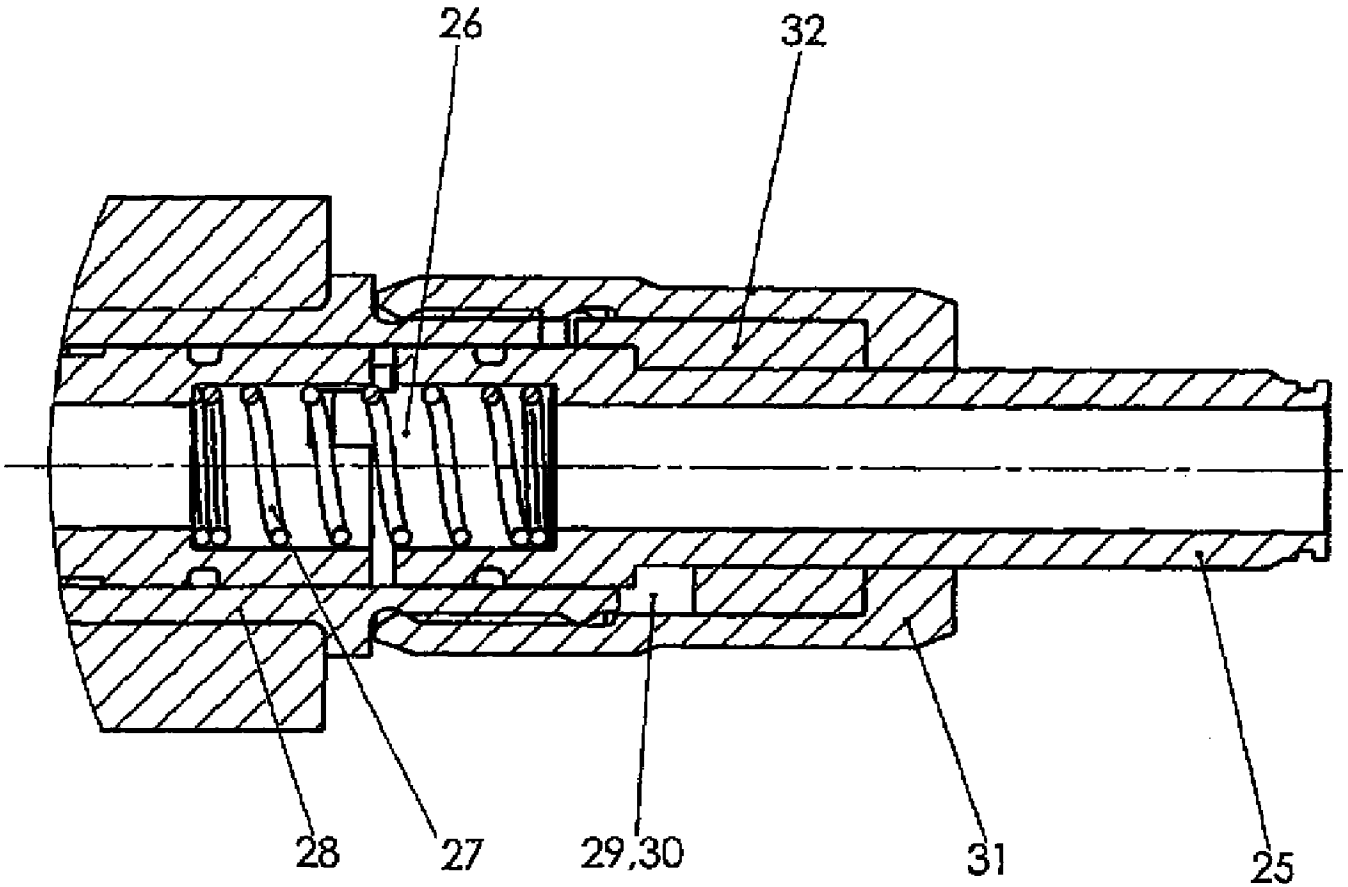
Figure 8:
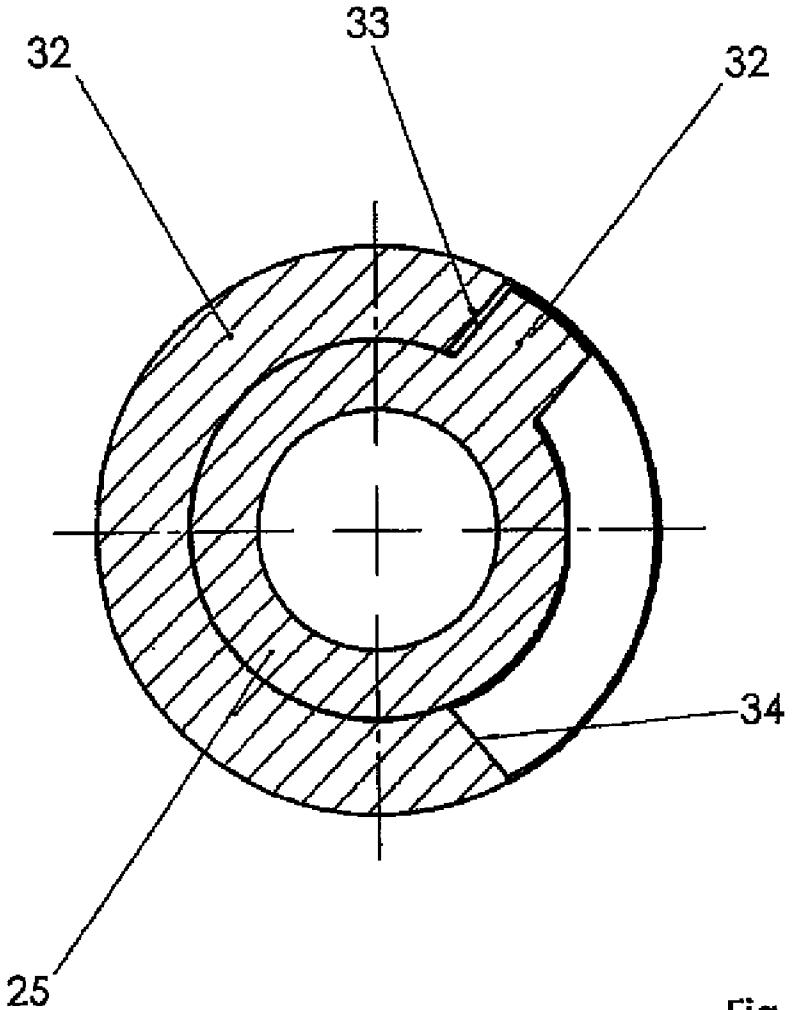

When the operational air hose 5 with a connection sleeve 25 is turned by 90°, the control pipe is locked in place by moving a pin 33 out of an indentation 29*a* on the counter sleeve 32, until the pin 33 encounters, starting from its position illustrated in FIG. 8, an exposed stop surface 34 and—by moving across the elevations 30 located between the indentations—latches in another indentation 29*b* which is not visible in the illustration of FIG. 7 and associated with the stop surface 34 or the other operating position.

Figure 9A:
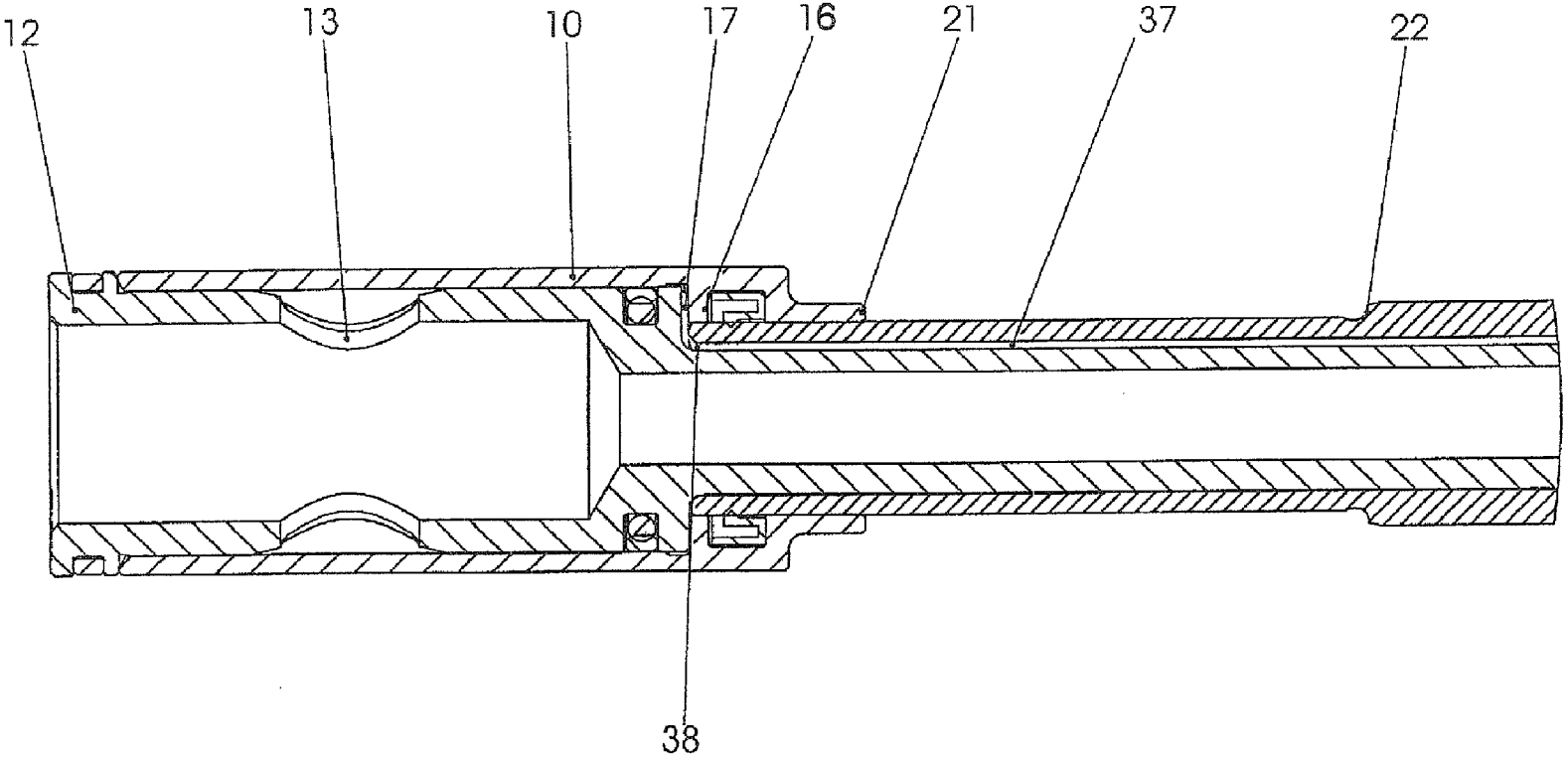
Figure 9B:
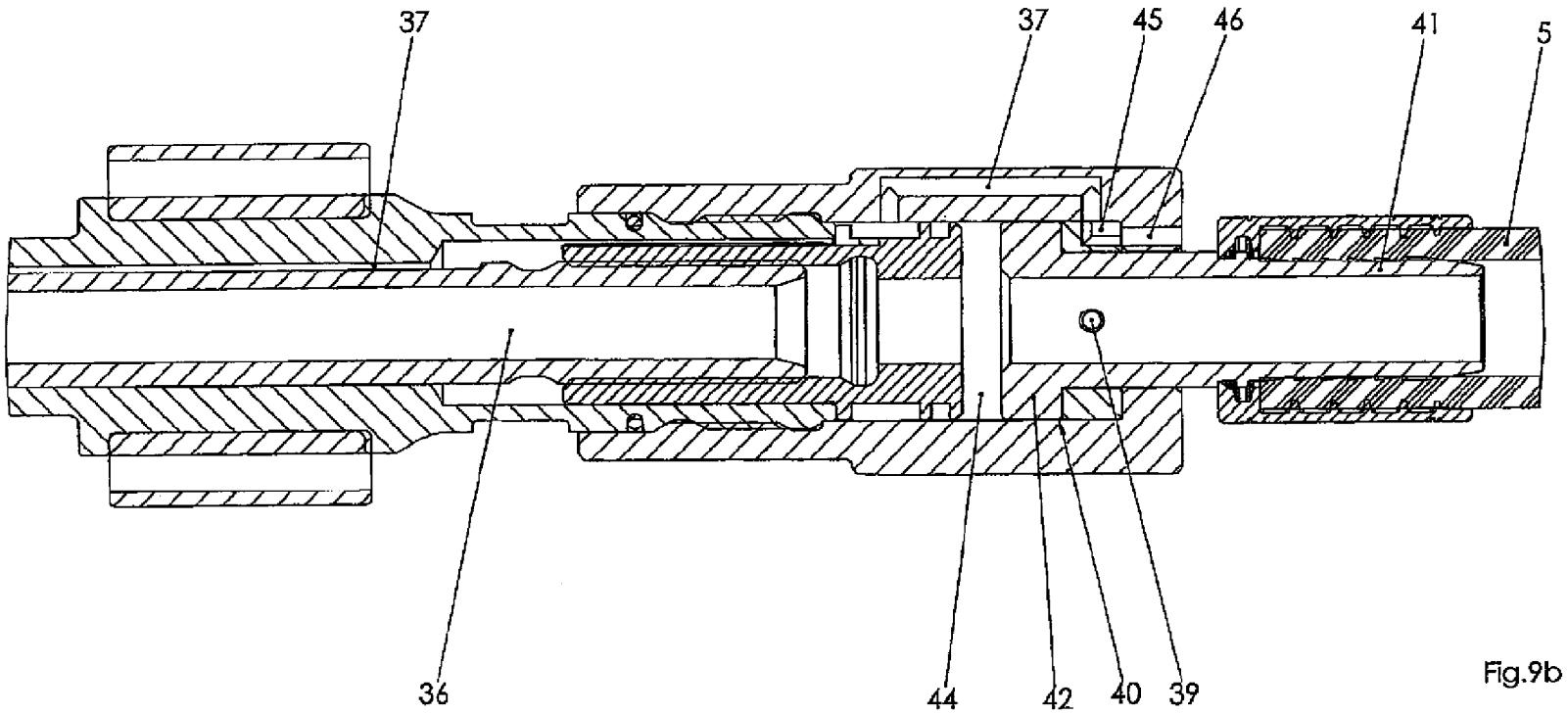
Figure 10:
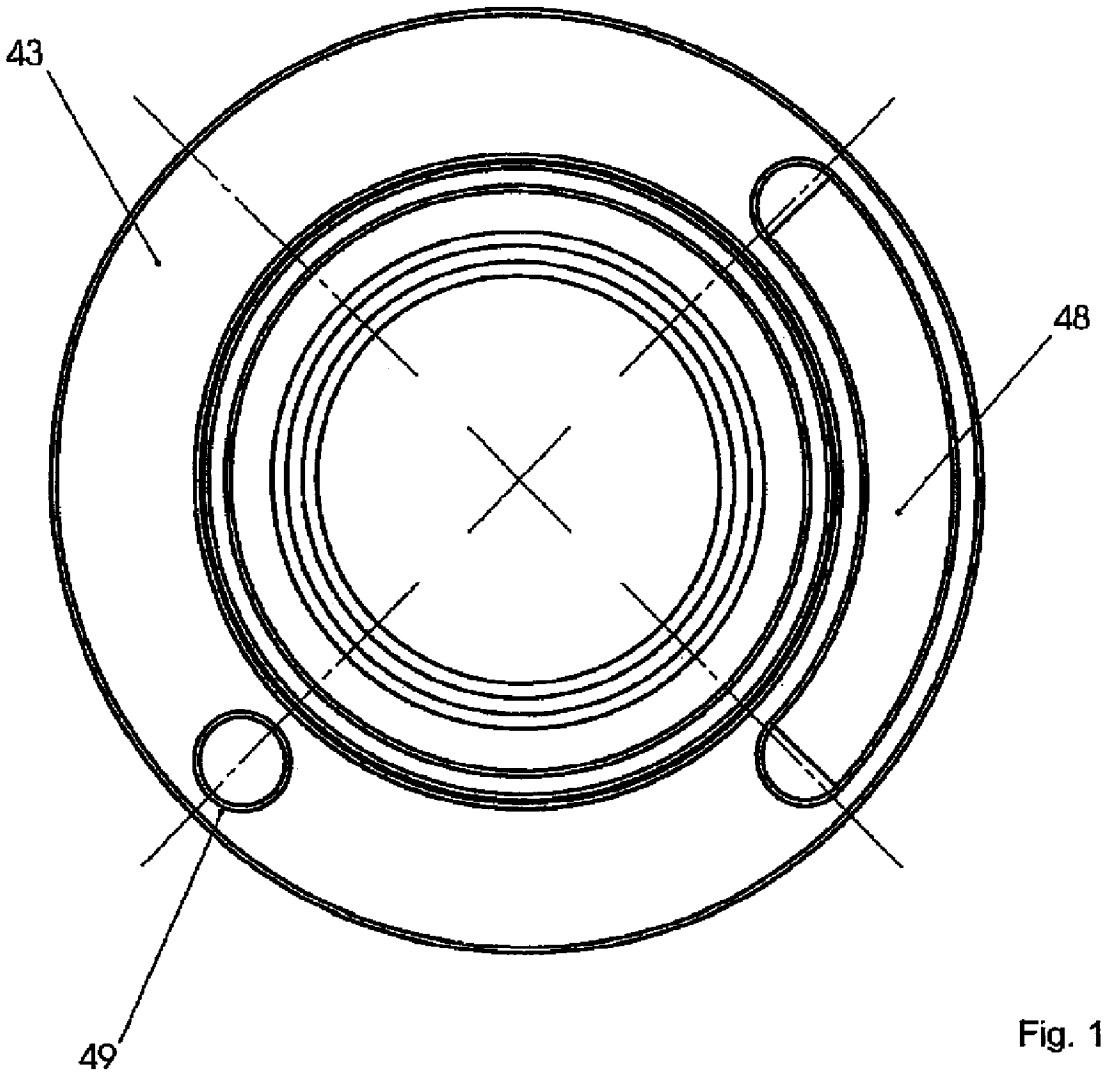
Figure 11:
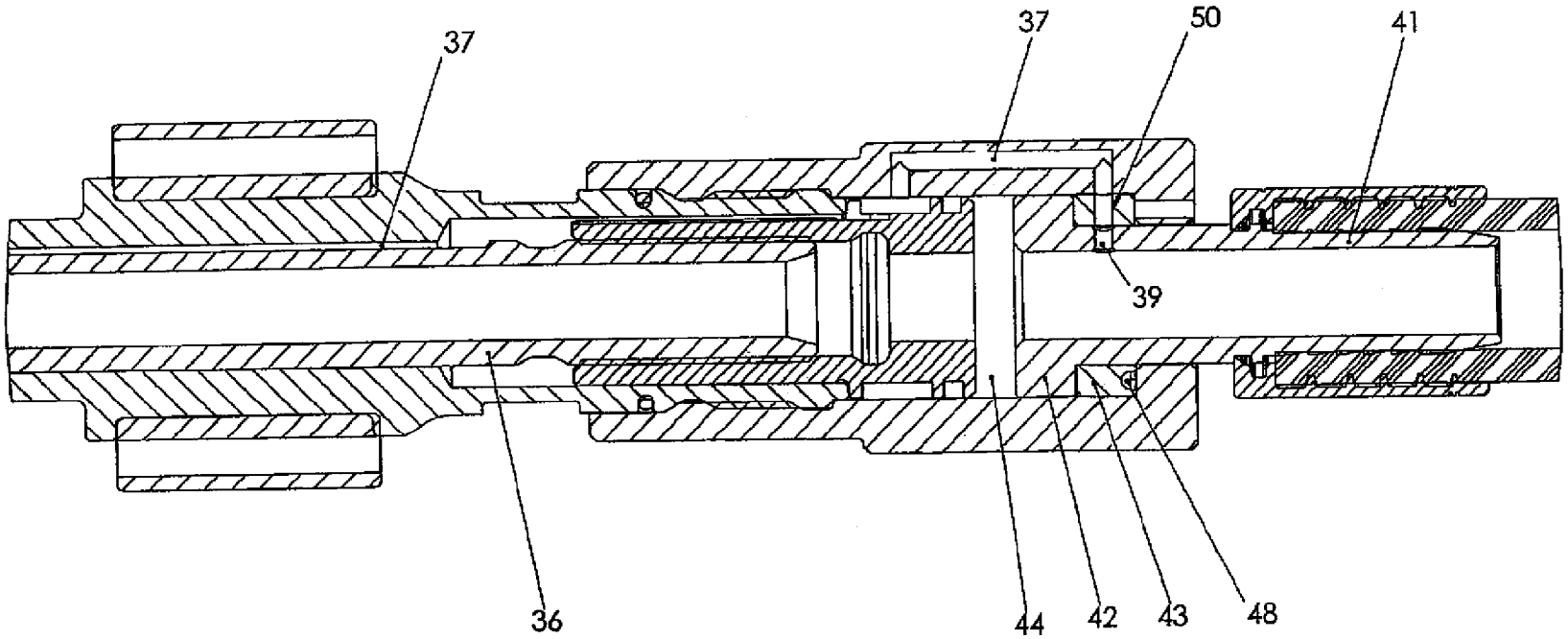

In the exemplary embodiment illustrated in FIGS. 9 to 11, a typical control pipe 36 is non-rotatably and immovably arranged in the device casing 1. The control pipe 36 includes a longitudinal channel 37 which feeds at 38 directly into the control chamber 16. A rotary valve 40 with a branch bore 39 is provided in the region of the rear end of the control pipe 36. The rotary valve 40 includes a connection sleeve 41 for the operational-air hose 5 and a control disk 42 with a permanently elastic coating 43. The control disk 42 is connected with the connection sleeve 41 to form a single part, and sealingly presses the coating 43 against the rear casing wall of the protective casing 1 with the assistance of the operational air in the pressure chamber 44.

The longitudinal channel 37 continues with different cross section and different path via the device interior to a two-part vent channel. This vent channel has an L-shaped opening 45 in the elastic coating 43 and a vent bore 46 which is located in the rear casing wall and aligned in a valve position for forward travel (FIG. 9*b*).

The vent bore 46 illustrated in FIG. 9*b* is actuality arranged in front of the rear casing wall at an angular offset of 90° relative to the mouth of the longitudinal channel 37 and is connected in the operating position for forward travel with the longitudinal channel through a kidney-shaped groove 48 in the coating 43 (FIG. 10).

In addition, an operational-air channel 50 extends through the coating 43 of the control disk 42 and connects the branch bore 39 with the rear, approximately U-shaped end of the longitudinal channel 37 in the operating position for backward travel (FIG. 11). As a result, the control pipe 36 supplies operational air to the control chamber 16 which moves the control sleeve 10 from the operating position illustrated in FIG. 9 to the rear operating position according to FIG. 11.

Figure 12:
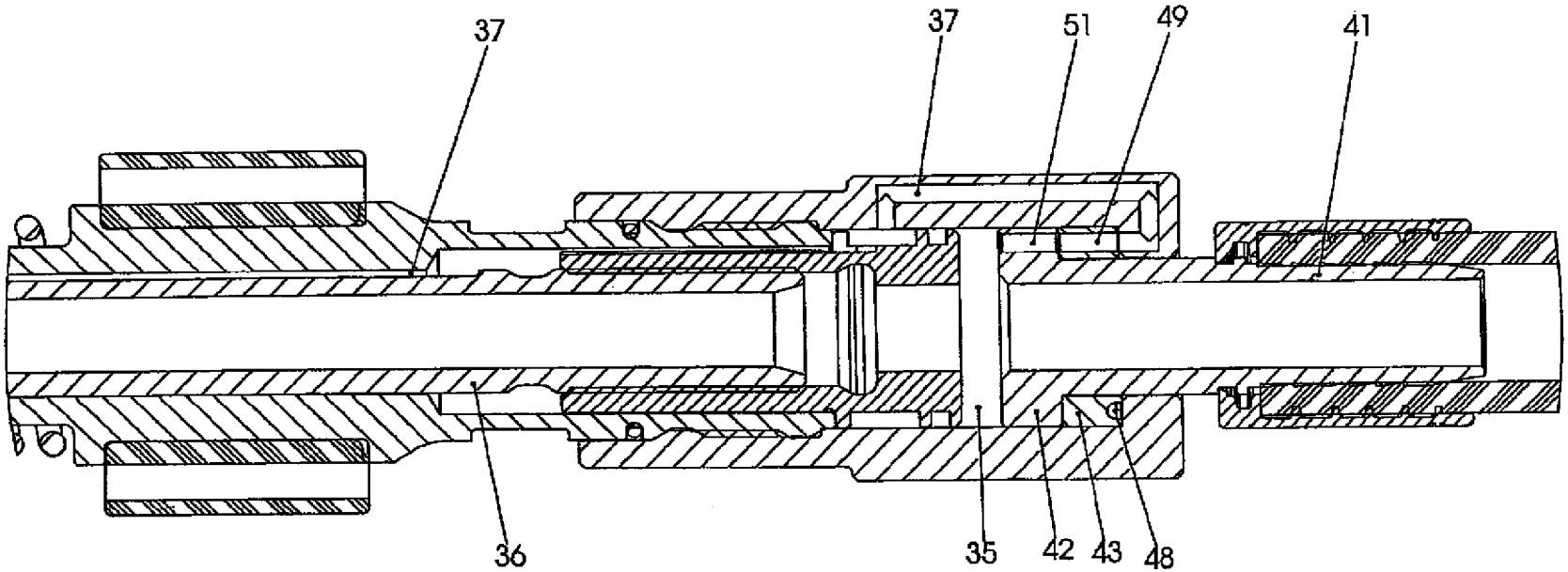

The exemplary embodiment of FIG. 12 differs from the exemplary embodiment of FIGS. 9 and 11 only in that the branch bore 39 is eliminated and operational air is supplied to the control chamber 16 from the pressure chamber 35. This is accomplished through an axis-parallel bore 51 extending through the control disk 42 and the coating 43, with the bore 51 being aligned in the rotary valve position for the backward travel with the open end of the longitudinal channel (FIG. 12).

In the exemplary embodiments of FIGS. 9 and 12, the pressure secured the control disk in its respective position by friction. In the operating position for forward travel, the control chamber 16 is vented in the same manner as illustrated for the other rotary valve variant in FIG. 9.

FIGS. 13 to 17 illustrate an exemplary embodiment of a rotary valve control in which the control pipe 54 is arranged immovably in the device casing and non-rotatably by way of an L-shaped bolt 74, whereas the rear section of the control pipe has a rotary valve 70. The inner collar 60*a* of a control sleeve 60 is guided on a slide ring 61 on the front section of the control pipe and on an outer collar 65*a* of an outer pipe 65 surrounding the control pipe 54. The control sleeve 60 can be moved with operational air in both directions. A control chamber 66, in which a longitudinal channel 68 feeds into, is located between the inner collar 60*a* and an outer collar 65*a*. The channel 68 includes a longitudinal groove 69 in the wall of the control pipe 54 which is covered to the outside by the outer pipe 65.

The rotary valve 70 has a branch bore 79 in the region of the rear end of the control pipe 54. The branch bore 79 is closed during the backward travel (FIG. 13) by the wall of the control pipe 541 whereas the control chamber 66 is connected to atmosphere, i.e. vented, through the longitudinal channel 68 and a vent channel 69*a* having vent bores 69*b*, 69*c*.

Figure 14:
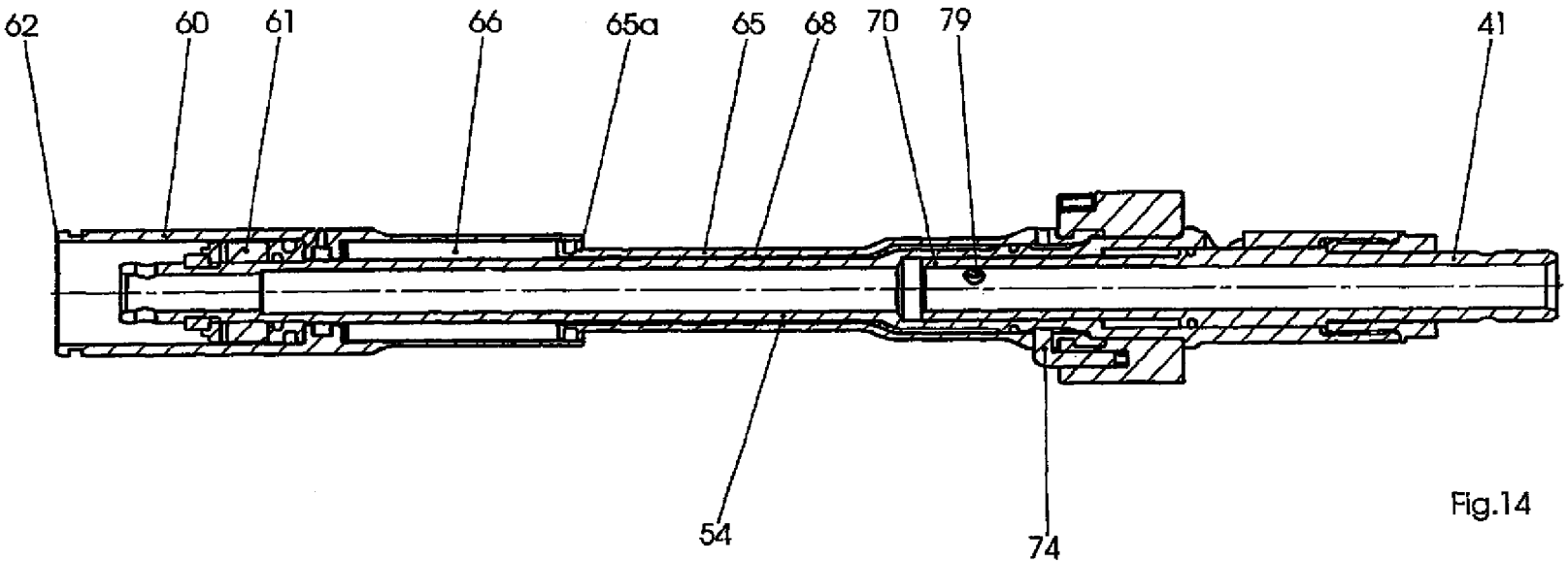
Figure 15:
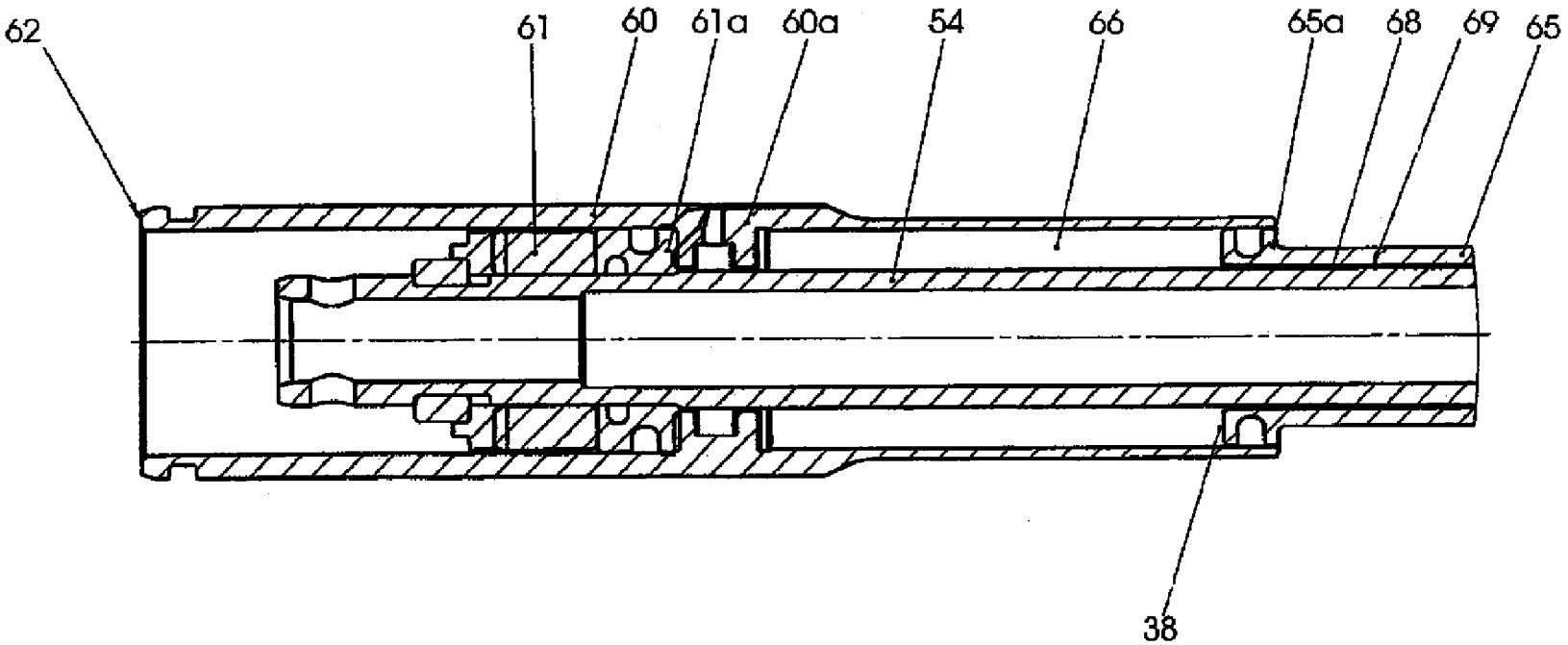
Figure 16:
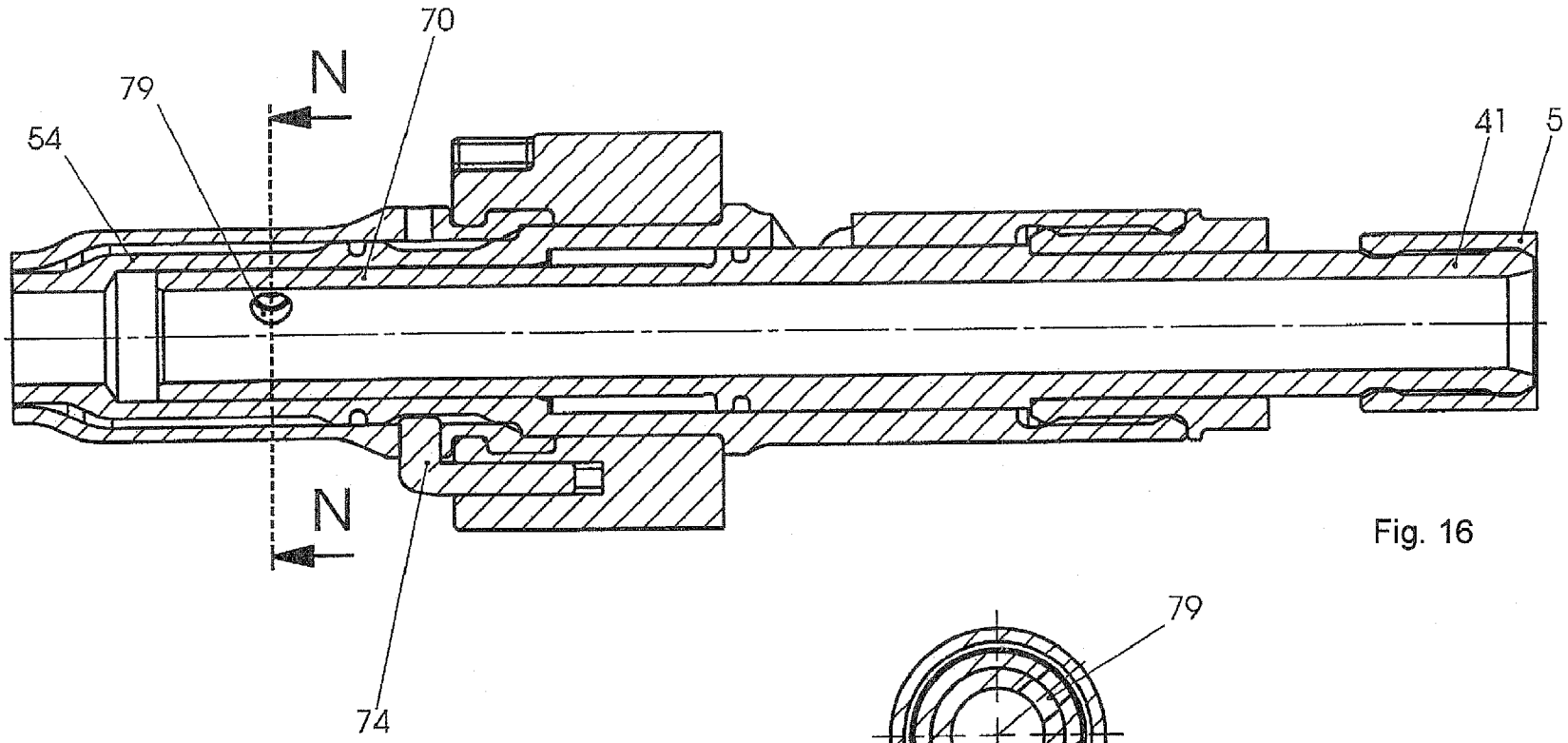
Figure 16A:
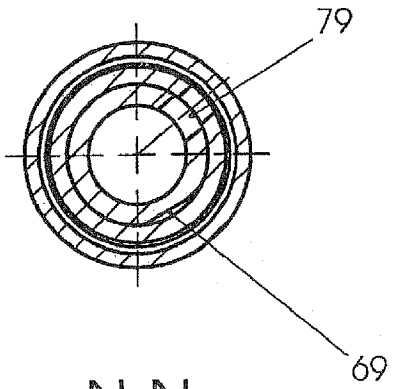
Figure 17:
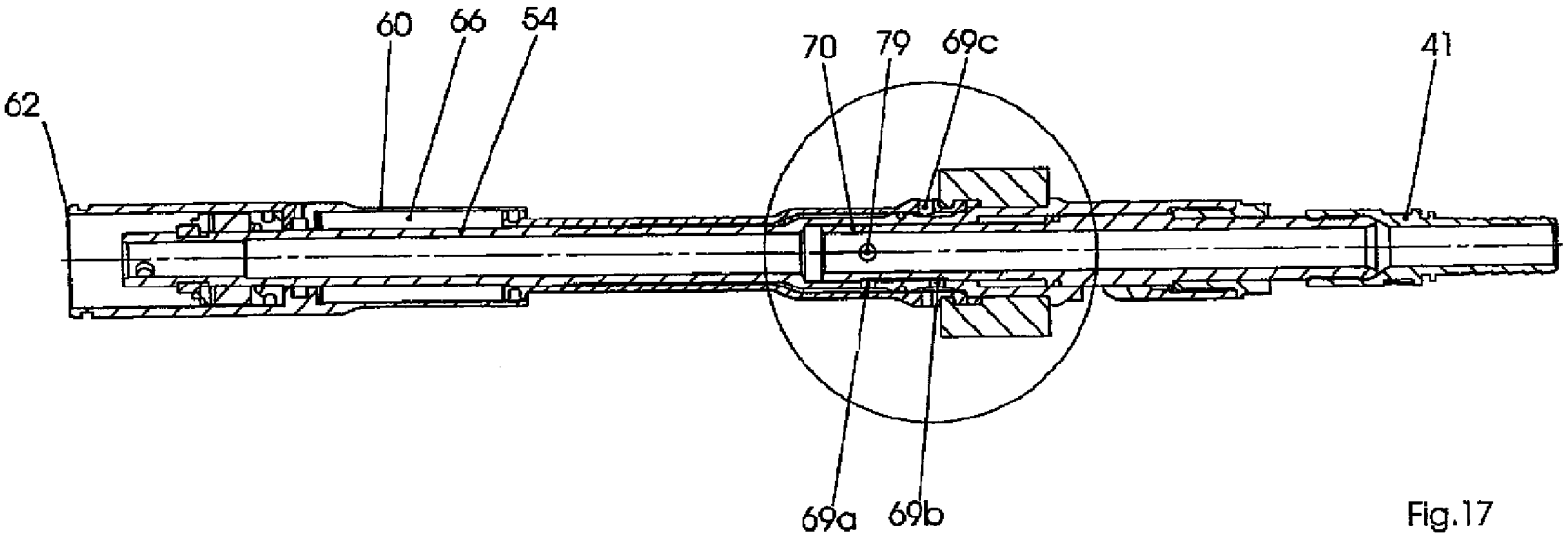
Figure 17:
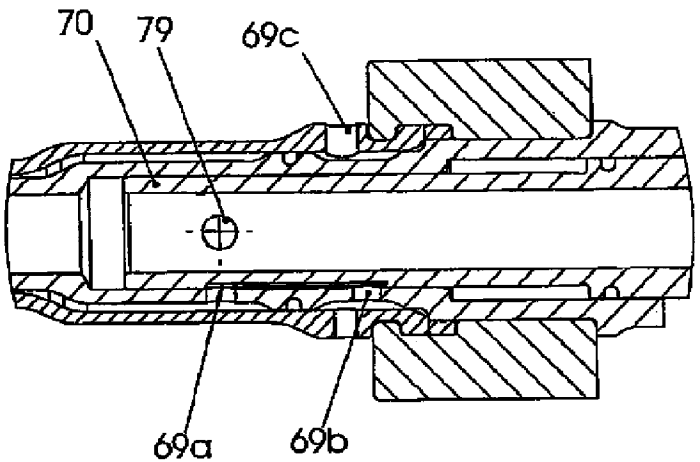

For the operating position for forward travel (FIGS. 14, 15), the branch opening 79 of the rotary valve 70 is connected with the control chamber 66 through the longitudinal channel 68 by a 90° rotation (FIG. 14).

Figure 13:
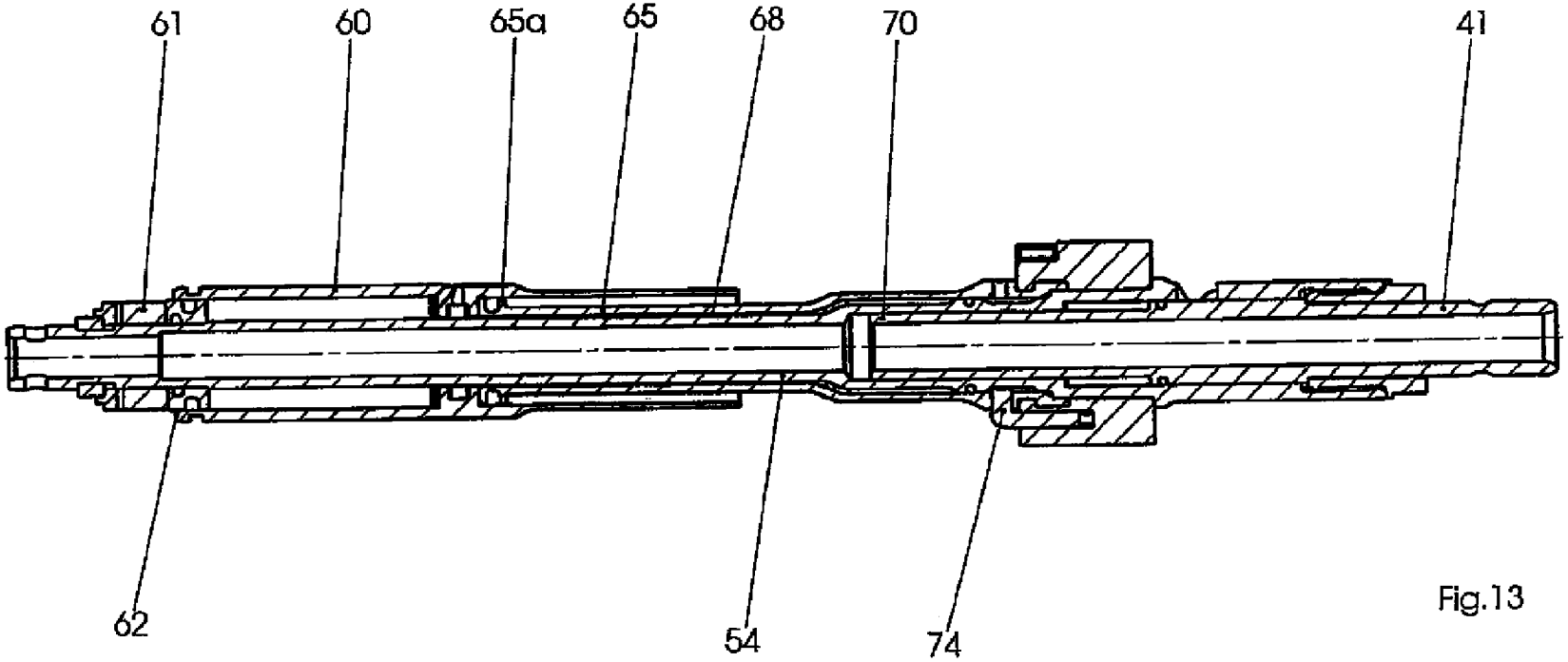

The effective areas inside the control chamber 66 are acted upon by the operational air supplied through the longitudinal channel 68 and dimensioned relative to the effective areas located at the end face 62 of the control sleeve 60 such that the same operational-air pressure in the control chamber 66 and in the area of the end face 62 causes displacement of the control sleeve 60 toward the slide ring 61 and hence into the operating position for forward travel. The inner collar 60*a* (FIGS. 14, 15, 17) of the control sleeve 60 bears hereby upon the backside 61*a* of the slide ring 61, and migrates to the outer collar 65*a* of the outer pipe 65, when switching to the return-travel position (FIG. 13).

A simple turning of the operational-air hose by 90° therefore causes the control sleeve 60 to move from its return-travel position (FIG. 13) in opposition to the operational air acting on the end face 62 of the control sleeve 60 forwards to its position for forward travel (FIGS. 14, 15, 17), whereas a turning of the operational-air hose back by 90° causes the control sleeve to return to the operating position for the backward travel due to the operational-air pressure acting on the end face 62 of the control sleeve 60, i.e. when the control chamber 66 is vented.

Thus, a simple quarter turn of the rotary valve in either direction enables a reversal of the device solely by means of operational air pressure.

What is claimed is:

1. A ram boring device, comprising:

a casing, a percussion piston disposed inside the casing and constructed for back and forth movement;

a control pipe immovable in an axial direction and having at least one control opening, said control pipe being configured as a rotary valve for rotation between a first position and a second position, a control sleeve disposed in surrounding relationship to the control pipe between the control pipe and the percussion piston, said control sleeve being constructed to define a control chamber with the control pipe, and a substantially torsion-resistant operational-air line rotatably coupled to the control pipe for supply of operational air to the control chamber to axially move the control sleeve from a forward position to a backward position, when the control pipe is turned to the first position, wherein the control chamber is vented, when the control pipe is rotated to the second position to thereby allow movement of the control sleeve from the backward position to the rearward position.

2. The ram boring device of claim 1, wherein the first and second positions are spaced by 90° .

3. The ram boring device of claim 2, further comprising a connection sleeve defining with a rear end of the control pipe a pressure chamber under system pressure and in communication with the operational-air line.

4. The ram boring device of claim 3, further comprising a compression spring arranged inside or outside the pressure chamber.

5. The ram boring device of claim 3, wherein the pressure chamber has two portions engaging one another in a claw-like fashion.

6. The ram boring device of claim 1, wherein the control pipe is rotatably supported and constructed in an area of the control chamber with a radial branch bore and a longitudinal channel which is disposed at an angular offset to the branch bore, said control chamber fluidly connected to a connecting channel for connecting the branch bore to the control chamber, when the control pipe is turned to the first position.

7. The ram boring device of claim 1, further comprising an outer sleeve in surrounding relationship to the control pipe, and a counter sleeve connected to a tubular extension of an outer pipe and having indentations and a protrusion configured for engagement with a pin.

8. The ram boring device of claim 1, wherein the rotary valve comprises a closable opening arranged in the control pipe proximate to a rear end of the control pipe and operates the control sleeve by way of a longitudinal channel extending from the control chamber.

9. The ram boring device of claim 8, wherein the percussion piston defines an axis, said rotary valve including a control disk with a radial first channel and a second channel in parallel relationship to the axis, said control chamber communicating with the first and second channels for pressurizing or venting the control chamber.

10. The ram boring device of claim 9, wherein the control disk comprises a metallic disk with a permanently elastic coating.

11. The ram boring device of claim 9, wherein the rotary valve has a branch bore, said branch bore and said radial channel being in alignment with a passageway that communicates with the longitudinal channel and the control chamber, when the rotary valve is in the first position, wherein the radial channels connects the longitudinal channel with a vent bore, when the rotary valve is in the second position.

12. The ram boring device of claim 11, wherein the control pipe is supported non-rotatably and immovably in the casing and is in communication with pressure chamber which in the first position of the rotary valve is connected by an axis-parallel channel to the longitudinal channel which branches off from the control chamber.

13. The ram boring device of claim 12, wherein in the second position, the longitudinal channel is connected with the vent bore via an axis-parallel bore disposed in the control disk.

14. The ram boring device of claim 1, wherein the control sleeve has an end surface, said end surface and said control chamber being dimensioned such that operational-air pressure inside the control chamber acts upon the control sleeve with a greater longitudinal force than an opposing operational-air pressure applied upon the end surface.

* * * * *